US010916196B2

(12) United States Patent
Moon et al.

(10) Patent No.: US 10,916,196 B2
(45) Date of Patent: Feb. 9, 2021

(54) ORGANIC LIGHT EMITTING DISPLAY DEVICE AND METHOD OF DRIVING THE SAME

(71) Applicant: SAMSUNG DISPLAY CO., LTD., Yongin-si (KR)

(72) Inventors: Yeon Keon Moon, Yongin-si (KR); Joon Seok Park, Yongin-si (KR); Kwang Suk Kim, Yongin-si (KR); Tae Sang Kim, Yongin-si (KR); Geunchul Park, Yongin-si (KR); Jun Hyung Lim, Yongin-si (KR); Kyungjin Jeon, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 16/550,966

(22) Filed: Aug. 26, 2019

(65) Prior Publication Data

US 2020/0126485 A1 Apr. 23, 2020

(30) Foreign Application Priority Data

Oct. 17, 2018 (KR) ..... 10-2018-0123716

(51) Int. Cl.
*G09G 3/3258* (2016.01)
*G09G 3/3291* (2016.01)

(52) U.S. Cl.
CPC ..... *G09G 3/3258* (2013.01); *G09G 3/3291* (2013.01)

(58) Field of Classification Search
CPC ..... G09G 3/3258; G09G 3/3291
See application file for complete search history.

(56) References Cited

U.S. PATENT DOCUMENTS

2008/0284691 A1* 11/2008 Chung ..... G09G 3/3291 345/76
2014/0168194 A1* 6/2014 Kong ..... G09G 3/3266 345/212
2017/0193900 A1* 7/2017 Kwon ..... G09G 3/3233
2017/0352690 A1* 12/2017 Yamazaki ..... H01L 29/66969

FOREIGN PATENT DOCUMENTS

KR 10-1263538 B1 5/2013
KR 10-2017-0027349 A 3/2017
KR 10-2018-0001638 A 1/2018

* cited by examiner

*Primary Examiner* — Kevin M Nguyen
(74) *Attorney, Agent, or Firm* — Kile Park Reed & Houtteman PLLC

(57) ABSTRACT

An organic light emitting display device may include a display panel, a source driving circuit, and a voltage generator. The display panel may include a pixel circuit including a driving transistor to drive an organic light emitting diode. The driving transistor may have four independent terminals including first and second gate electrodes. The source driving circuit may provide a data voltage to the pixel circuit. The voltage generator may apply an independent bias voltage to the second gate electrode of the driving transistor to control a driving voltage range of the driving transistor.

19 Claims, 6 Drawing Sheets

FIG. 6

| Vb | | Ion | Vth | VD_range | SS | Mob |
|---|---|---|---|---|---|---|
| -15 | Vd=5.1 Vb=-15 | 2.77E-07 | 10.01 | 7.37 | 0.31 | 0.80 |
| -14 | Vd=5.1 Vb=-14 | 3.99E-07 | 9.26 | 6.99 | 0.31 | 0.89 |
| -13 | Vd=5.1 Vb=-13 | 5.52E-07 | 8.57 | 5.59 | 0.26 | 0.98 |
| -12 | Vd=5.1 Vb=-12 | 7.41E-07 | 7.91 | 6.18 | 0.26 | 1.09 |
| -11 | Vd=5.1 Vb=-11 | 9.64E-07 | 7.23 | 5.85 | 0.22 | 1.21 |
| -10 | Vd=5.1 Vb=-10 | 1.22E-06 | 6.56 | 5.57 | 0.21 | 1.33 |
| -9 | Vd=5.1 Vb=-9 | 1.22E-06 | 5.94 | 5.25 | 0.21 | 1.46 |
| -8 | Vd=5.1 Vb=-8 | 1.22E-06 | 5.32 | 4.96 | 0.21 | 1.59 |
| -7 | Vd=5.1 Vb=-7 | 2.20E-06 | 4.71 | 4.69 | 0.20 | 1.73 |
| -6 | Vd=5.1 Vb=-6 | 2.57E-06 | 4.10 | 4.44 | 0.16 | 1.88 |
| -5 | Vd=5.1 Vb=-5 | 2.98E-06 | 3.51 | 4.21 | 0.16 | 2.04 |
| -4 | Vd=5.1 Vb=-4 | 3.40E-06 | 2.92 | 4.00 | 0.16 | 2.22 |
| -3 | Vd=5.1 Vb=-3 | 3.84E-07 | 2.33 | 3.81 | 0.16 | 2.44 |
| -2 | Vd=5.1 Vb=-2 | 4.28E-06 | 1.75 | 3.62 | 0.16 | 2.73 |
| -1 | Vd=5.1 Vb=-1 | 4.74E-06 | 1.21 | 3.41 | 0.13 | 3.08 |
| 0 | Vd=5.1 Vb=0 | 5.19E-06 | 0.64 | 3.26 | 0.14 | 3.47 |
| 1 | Vd=5.1 Vb=1 | 5.65E-06 | 0.11 | 3.08 | 0.15 | 3.85 |
| 2 | Vd=5.1 Vb=2 | 6.11E-06 | -0.46 | 2.97 | 0.13 | 4.21 |
| 3 | Vd=5.1 Vb=3 | 6.56E-06 | -1.00 | 2.83 | 0.14 | 4.54 |
| 4 | Vd=5.1 Vb=4 | 7.01E-06 | -1.57 | 2.76 | 0.13 | 4.81 |
| 5 | Vd=5.1 Vb=5 | 7.46E-06 | -2.14 | 2.71 | 0.14 | 5.03 |
| 6 | Vd=5.1 Vb=6 | 7.91E-06 | -2.67 | 2.63 | 0.14 | 5.23 |

ORGANIC LIGHT EMITTING DISPLAY DEVICE AND METHOD OF DRIVING THE SAME

CROSS-REFERENCE TO RELATED APPLICATION

Korean Patent Application No. 10-2018-0123716, filed on Oct. 17, 2018, in the Korean Intellectual Property Office, and entitled: "Organic Light Emitting Display Device and Method of Driving the Same," is incorporated by reference herein in its entirety.

BACKGROUND

1. Field

Exemplary embodiments relate to an organic light emitting display device and a method of driving the organic light emitting display device. More particularly, exemplary embodiments relate to an organic light emitting display device with an improved display quality and a method of driving the organic light emitting display device with the improved display quality.

2. Description of the Related Art

An organic light emitting display device is spotlighted as a next generation display device because the organic light emitting display device has a thin thickness, a light weight, a low power consumption, and a fast response time.

The organic light emitting display device may include a plurality of pixels. Each pixel may include an organic light emitting diode and a pixel circuit for driving the organic light emitting diode. The pixel circuit may include a plurality of transistors and a plurality of capacitors. The plurality of transistors may drive the organic light emitting diode. The organic light emitting diode may emit a light with a luminance corresponding to a driving voltage.

Recently, as the organic light emitting display device has a higher resolution and a larger size, an area of the pixel circuit has been reduced and minimized. Thus, the plurality of transistors in the area of the pixel circuit may have a reduced size and a poor driving capacity due to the area limitation. As a result, a display quality of the organic light emitting display device may be degraded due to the degraded transistors.

SUMMARY

Embodiments are directed to an organic light emitting display device including: a display panel including a plurality of pixel circuits, each pixel circuit including a driving transistor having four independent terminals, the four independent terminals including first and second gate electrodes, and an organic light emitting diode to emit a light according to a driving current generated from the driving transistor; a source driving circuit to provide a data voltage to the plurality of pixel circuits such that a gate voltage corresponding to the data voltage is applied to the first gate electrode of the driving transistor; and a voltage generator to apply an independent bias voltage to the second gate electrode of the driving transistor, the independent bias voltage for controlling a driving voltage range of the driving transistor, wherein: a channel length of the driving transistor is about 3 μm or less, and a voltage level of the independent bias voltage is about −7 V to about 6 V.

The driving transistor may further include a drain electrode to receive a first emission power supply voltage and a source electrode connected to the organic light emitting diode.

The driving voltage range of the driving transistor may be a range of gate voltages corresponding to data voltages corresponding to a middle grayscale and higher grayscales.

The driving voltage range of the driving transistor may be about 2 V or more to about 5 V or less.

The driving voltage range of the driving transistor may be about −5 V to about 5 V.

A sub-threshold voltage slope of the driving transistor may be about 0.11 V/dec to about 0.21 V/dec.

Each pixel circuit further may include a switching transistor and a capacitor, and wherein: the switching transistor includes a gate electrode connected to a scan line, a source electrode connected to a data line, and a drain electrode connected to the first gate electrode of the driving transistor, and the capacitor includes a first electrode connected to the first gate electrode of the driving transistor and a second electrode to receive a first emission power supply voltage.

The display panel may include a base substrate, an active pattern of the driving transistor, and a voltage line to transfer the independent bias voltage, wherein: the first gate electrode overlaps a channel region of the active pattern and is on the active pattern, the second gate electrode is on the base substrate, is under the channel region, and is connected to the voltage line, and the active pattern includes an oxide semiconductor, overlaps the second gate electrode, and is on the second gate electrode, and wherein the active pattern is between the first and second gate electrodes.

Embodiments are directed to a method of driving an organic light emitting display device including a plurality of pixel circuits, each pixel circuit including an organic light emitting diode and a driving transistor having four independent terminals to drive the organic light emitting diode, the four independent terminals including first and second gate electrodes, the method comprising: applying a gate voltage corresponding to a data voltage to the first gate electrode of the driving transistor; applying an independent bias voltage to the second gate electrode of the driving transistor to control a driving voltage range of the driving transistor; and applying a driving current based on the gate voltage to the organic light emitting diode, wherein: a channel length of the driving transistor is about 3 μm or less, and a voltage level of the independent bias voltage is about −7 V to about 6 V.

The driving transistor may further include a drain electrode to receive a first emission power supply voltage and a source electrode connected to the organic light emitting diode.

The driving voltage range of the driving transistor may be about 2 V or more to about 5 V or less.

The driving voltage range of the driving transistor may be about −5 V to about 5 V.

A sub-threshold voltage slope of the driving transistor may be about 0.11 V/dec to about 0.21 V/dec.

The method of driving an organic light emitting display device may further include applying the gate voltage corresponding to the data voltage to the first gate electrode of the driving transistor in response to a scan signal; storing the gate voltage of the first gate electrode in a capacitor; and applying a driving current to the organic light emitting diode based on a voltage stored in the capacitor by the driving transistor.

The independent bias voltage may be applied through a voltage line connected to the second gate electrode of the driving transistor.

Embodiments are directed to a pixel unit comprising: an organic light emitting diode to emit a light corresponding to a data voltage of a grayscale; and a pixel circuit to drive the organic light emitting diode according to the data voltage of the grayscale, the pixel circuit including a driving transistor having four independent terminals, the four independent terminals including first and second gate electrodes, wherein: the driving transistor generates a driving current according to a first gate voltage of the first gate electrode of the driving transistor corresponding to the data voltage of the grayscale and supplies the driving current to the organic light emitting diode, and a driving voltage range of the driving transistor is controlled by a second gate voltage of the second gate electrode of the driving transistor, the second gate voltage of the second gate electrode of the driving transistor being charged with an independent bias voltage.

The driving voltage range of the driving transistor may be a range of first gate voltages of the driving transistor corresponding to data voltages of a middle grayscale and higher grayscales.

The driving voltage range of the driving transistor may be about 2 V or more to about 5 V or less.

The driving voltage range of the driving transistor may be about −5 V to about 5 V.

A sub-threshold voltage slope of the driving transistor may be about 0.11 V/dec to about 0.21 V/dec.

BRIEF DESCRIPTION OF THE DRAWINGS

Features will become apparent to those of skill in the art by describing in detail exemplary embodiments with reference to the attached drawings in which:

FIG. 6 illustrates experimental data showing an independent bias voltage and a driving voltage range of a four-terminal transistor according to one exemplary embodiment.

DETAILED DESCRIPTION

Figure 1:
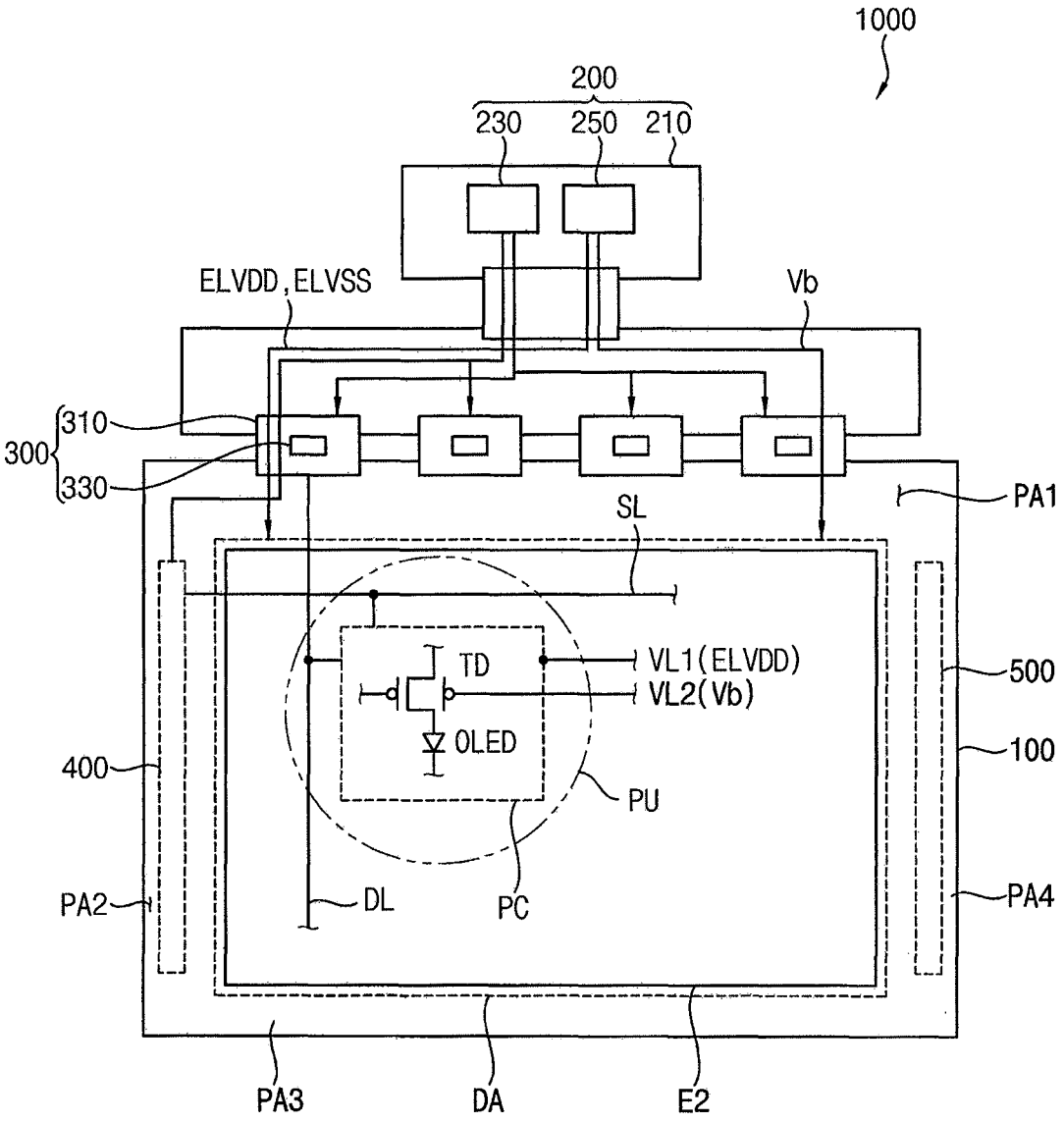
FIG. 1 illustrates an organic light emitting display device according to one exemplary embodiment.

FIG. 1 illustrates an organic light emitting display device 1000 according to one exemplary embodiment. Referring to FIG. 1, the organic light emitting display device 1000 may include a display panel 100, a main driver circuit 200, a source driver circuit 300, a scan driver circuit 400, and an emission driver circuit 500.

The display panel 100 may include a display part DA and a peripheral part. The peripheral part may include a plurality of peripheral areas PA1, PA2, PA3, and PA4 surrounding the display part DA.

The display part DA may include a plurality of data lines DL, a plurality of scan lines SL, a plurality of voltage lines VL1 and VL2, and a plurality of pixel units PU. The plurality of data lines DL may be connected to the source driver circuit 300 and may provide a plurality of data voltages to the plurality of pixel units PU. The plurality of scan lines SL may be connected to the scan driver circuit 400 and may provide a plurality of scan signals to the plurality of pixel units PU. The first voltage line VL1 may provide a first emission power supply voltage ELVDD to the plurality of pixel units PU. The second voltage line VL2 may provide an independent bias voltage Vb to the plurality of pixel units PU.

Each pixel unit PU may include a pixel circuit PC. The pixel circuit PC may be connected to a corresponding data line DL, a corresponding scan line SL, and corresponding voltage lines VL1 and VL2. Further, the pixel circuit PC may include a plurality of transistors and at least one capacitor. The plurality of transistors may include a driving transistor TD for driving an organic light emitting diode OLED. The driving transistor TD may be connected to an anode electrode of the organic light emitting diode OLED and may supply a driving current corresponding to a data voltage to the anode electrode of the organic light emitting diode OLED.

According to one exemplary embodiment, the driving transistor TD may include a channel and four independent terminals. The four independent terminals of the driving transistor TD may include a source electrode, a drain electrode, a first gate electrode, and a second gate electrode. The first gate electrode may be disposed over the channel. The second gate electrode may be disposed under the channel. The channel may be between the first and second gate electrodes The channel may include an oxide semiconductor. A length of the channel of the driving transistor may be less than or equal to about 3 μm. The channel length may be changed according to a resolution and a size of the display panel 100.

The main driver circuit 200 may include a timing controller 230 and a voltage generator 250 mounted on a main printed circuit board 210.

The timing controller 230 may receive an image signal and a control signal from an external device. The image signal may include red, green and blue image signals. The control signal may include a horizontal synchronization signal, a vertical synchronization signal, and a main clock signal. The timing controller 230 may output image data that are converted from the image signal according to specifications, e.g., a pixel structure and a resolution of the display part DA. The timing controller 230 may generate a first control signal for driving the source driver circuit 300 and a second control signal for driving the scan driver circuit 400 based on the control signal.

The voltage generator 250 may generate a plurality of driving voltages. The plurality of driving voltages may include a source driving voltage that is provided to the source driver circuit 300, a scan driving voltage that is provided to the scan driver circuit 400, and a panel driving voltage that is provided to the display panel 100.

The panel driving voltage may include a first emission power supply voltage ELVDD, a second emission power supply voltage ELVSS, and an independent bias voltage Vb. The panel driving voltage may be provided to the pixel circuit PC. The first emission power supply voltage ELVDD may be applied to an anode electrode of the organic light emitting diode OLED. The second emission power supply voltage ELVSS may be applied to a cathode electrode E2 of the organic light emitting diode OLED. The first emission power supply voltage ELVDD may be greater than the second emission power supply voltage ELVSS. The independent bias voltage Vb may be applied to a fourth terminal (e.g., the second gate electrode) of the driving transistor TD. The independent bias voltage Vb may have about −7V to about 6V.

The source driver circuit 300 may include a plurality of source driving units 330 that are mounted on a source printed circuit board 310. The plurality of source driving units 330 may include a flexible circuit film 331 and a source driving chip 333 mounted on the flexible circuit film 331. The source driver circuit 300 may be connected to a first peripheral area PA1 of the display panel 100. The source driver circuit 300 may convert the image data supplied from the timing controller 230 into a data voltage using a gamma voltage. The data voltage may be provided to the pixel units PU of the display panel 100.

The first emission power supply voltage ELVDD, the second emission power supply voltage ELVSS, and the independent bias voltage Vb may be provided to the display panel 100 through the source printed circuit board 310 without passing through the plurality of source driving units 330.

The scan driver circuit 400 may be disposed in the second peripheral area PA2 of the display panel 100. The scan driver circuit 400 may include a plurality of transistors that are directly formed in the second peripheral area PA2 by the same processor as manufacturing transistors included in the pixel circuit PC of the display part DA. The scan driver circuit 400 may generate a plurality of scan signals based on control signals provided from the timing controller 230 and may provide the plurality of scan signals to a plurality of scan lines SL.

Figure 2A:
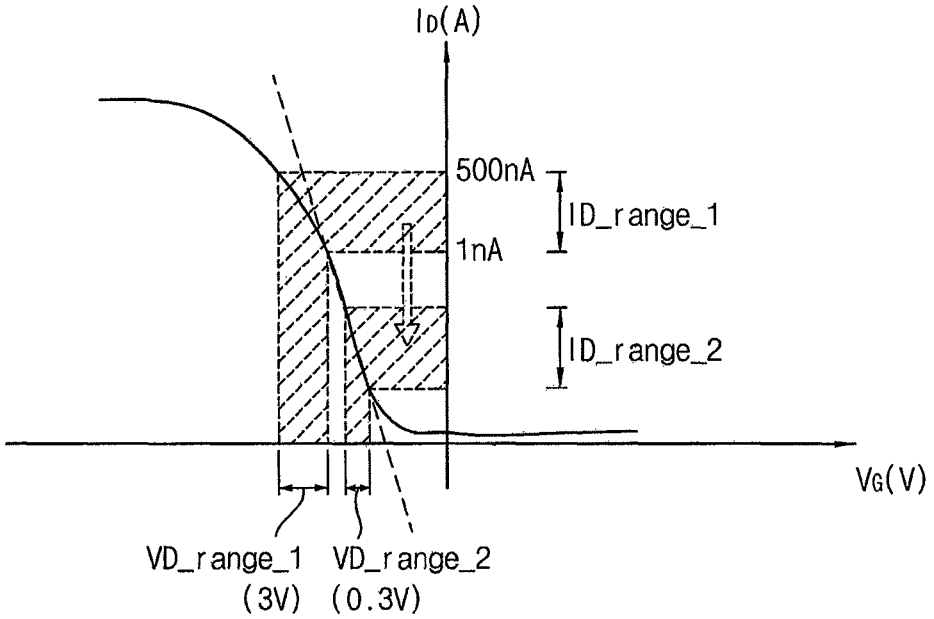
FIGS. 2A and 2B illustrate current-voltage (I-V) characteristic curves illustrating driving voltage ranges of driving transistors.
Figure 2B:
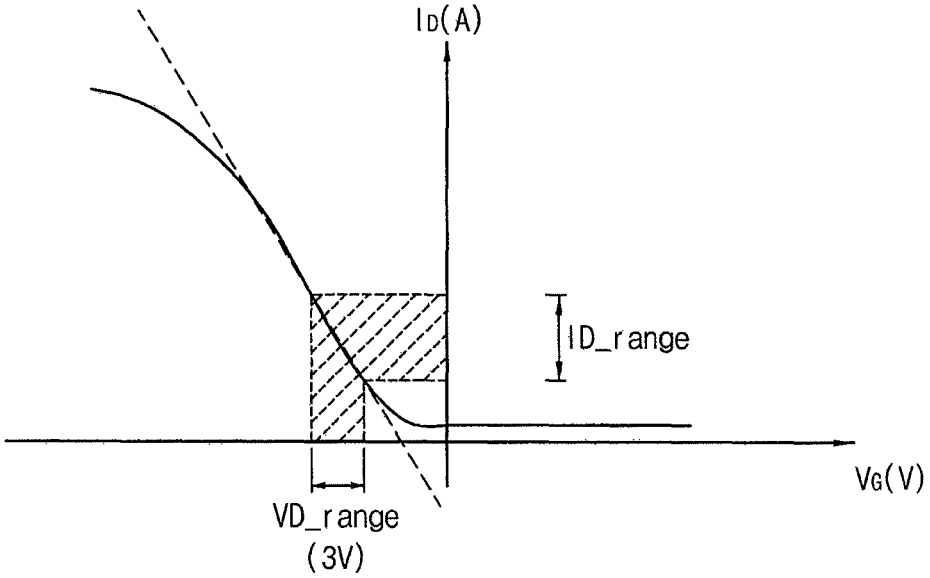

FIGS. 2A and 2B illustrate current-voltage (I-V) characteristic curves showing driving voltage ranges of driving transistors. Referring to FIG. 2A, according to a comparative exemplary embodiment, a driving transistor may have three terminals. The three terminals may include a gate electrode for receiving a data voltage, a drain electrode for receiving a first emission power supply voltage, and a source electrode connected to an anode electrode of an organic light emitting diode OLED.

According to the comparative exemplary embodiment, the driving transistor having the three terminals may have a driving current ID flowing from the drain electrode to the source electrode based on a gate voltage VG of the gate electrode corresponding to the data voltage. The driving current ID of the driving transistor may be applied to the organic light emitting diode OLED. The organic light emitting diode OLED may generate a light by the driving current ID. The driving current ID of the driving transistor may be changed according to the gate voltage VG and may control a luminance of a light emitted from the organic light emitting diode OLED.

In general, a pixel may display about 256 grayscales from a black grayscale to a white grayscale. Thus, the luminance of the light emitted from the organic light emitting diode OLED may display 256 grayscales. The data voltage provided to the driving transistor may include 256 grayscale voltages corresponding to 256 grayscales.

FIG. 2A illustrates the current-voltage (I-V) characteristic curve of the driving transistor having a first driving voltage range VD_range_I, a second driving voltage range VD_range_2, a first driving current range ID_range_1, and a second driving current range ID_range_2. When a gate voltage of the driving transistor is in the first driving voltage range VD_range_1, the driving transistor may flow a first current of the first driving current range ID_range_1. When the gate voltage of the driving transistor is in the second driving voltage range VD_range_2, the driving transistor may flow a second current of the second driving current range ID_range_2.

The first driving voltage range VD_range_1 may correspond to a data voltage range corresponding to a middle grayscale (e.g., 128 grayscale) or higher grayscales. For example, the first driving voltage range VD_range_1 may indicate a gate voltage range of the driving transistor when the data voltages of the middle grayscale or the high grayscales are applied to the driving transistor.

The second driving voltage range VD_range_2 may correspond to a data voltage range of lower grayscales. For example, the second driving voltage range VD_range_2 may indicate a gate voltage range of the driving transistor when the data voltages of the lower grayscales (e.g., less than 128 grayscale) are applied to the driving transistor. The second driving voltage range VD_range_2 may be narrower than the first driving voltage range VD_range_1.

As a driving current of a driving transistor is reduced, a driving voltage range VD_range of the driving transistor may be decreased. Further, as an organic light emitting display device has a higher resolution and a larger size, a size of the driving transistor may be reduced such that a driving current of the driving transistor is reduced (to, e.g., about 1 nA or less). Thus, the driving voltage range VD_range of the driving transistor may be decreased (to, e.g., about 0.3V) due to the reduced driving current of the driving transistor. As a result, the reduction of driving voltage range VD_range of the driving transistor may degrade a display quality of an organic light emitting display device.

TABLE

| Length | 2.5 μm | 3.5 μm | 4.5 μm |
|---|---|---|---|
| VD_range | 1.45 V | 1.75 V | 2.07 V |

Referring to Table above, when a channel length L of the driving transistor is about 4.5 μm, the driving voltage range VD_range of the driving transistor may be about 2.07 V (e.g., difference between minimum and maximum gate voltages of the driving transistor when data voltages corresponding to a middle grayscale or higher grayscale are applied to the driving transistor). When the channel length L of the driving transistor is about 3.5 μm, the driving voltage range VD_range of the driving transistor may be about 1.75 V. When the channel length L of the driving transistor is about 2.5 μm, the driving voltage range VD_range of the driving transistor may be about 1.45 V.

According to one exemplary embodiment, FIG. 2B illustrates a current-voltage (I-V) characteristic curve illustrating a driving voltage range VD_range of a driving transistor having four independent terminals. The four independent terminals may include a source electrode, a drain electrode, a first gate electrode over a channel, and a second gate electrode under the channel. For example, the four independent terminals may operate independently of each other.

A sub-threshold slope (SS) may indicate a slope of a curve below a threshold voltage of a transistor in a current-voltage (I-V) characteristic curve. As shown in FIGS. 2A and 2B, a sub-threshold slope (SS) of the driving transistor having the three terminals in FIG. 2A is steeper than that of the driving transistor having the four terminals in FIG. 2B.

According to one exemplary embodiment, the driving transistor with the four terminals having the channel length of about 3 μm or less, may obtain the driving voltage range VD_range to about 3 V or more by gently adjusting the sub-threshold slope (SS) which is the slope of the curve below the threshold voltage in the current-voltage (I-V) characteristic curve. For example, in order to smooth the sub-threshold voltage slope SS, an independent bias voltage Vb may be applied to the second gate electrode corresponding a fourth terminal of the driving transistor.

For example, the driving transistor having the four independent terminals may have a channel length L of about 3 μm or less, and a voltage level of the independent bias voltage Vb may be about −7 V to about 6 V.

Figure 3:
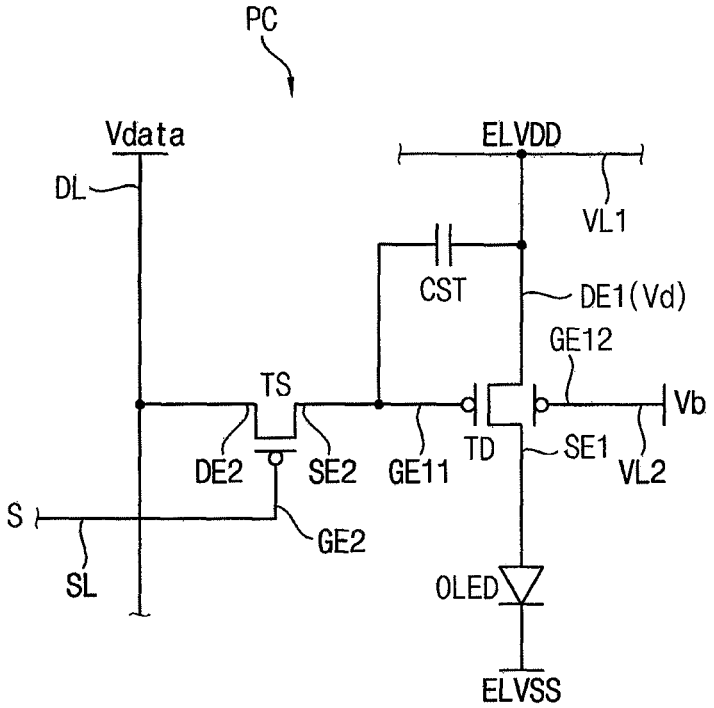
FIG. 3 illustrates a pixel circuit according to one exemplary embodiment.
Figure 4:
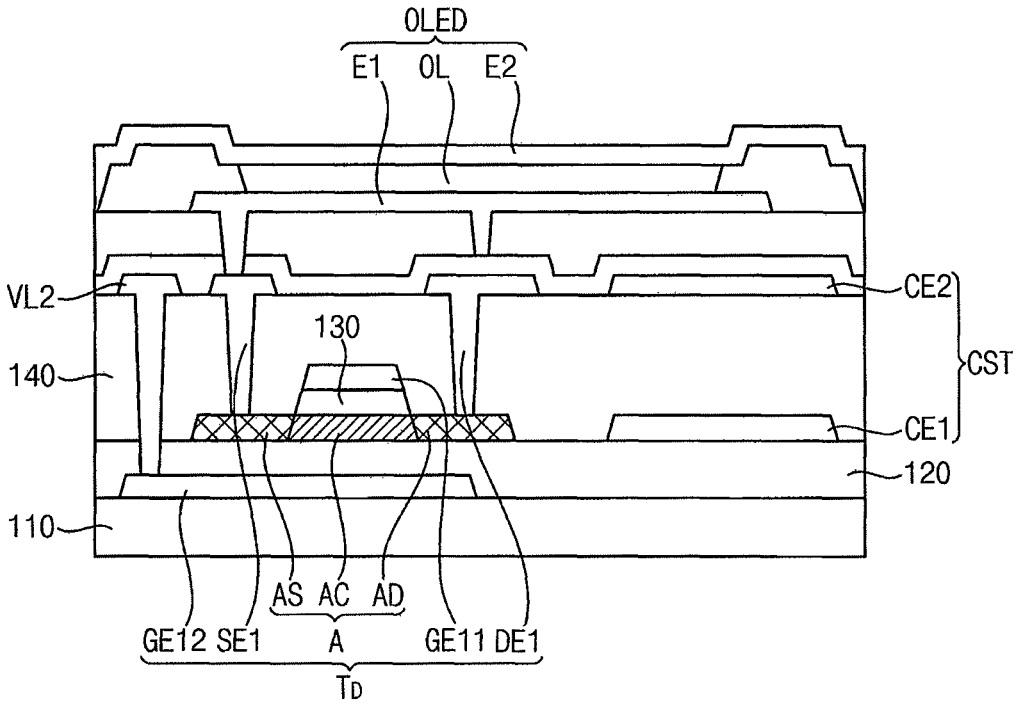
FIG. 4 illustrates a cross-sectional view of a display panel including a four-terminal transistor according to one exemplary embodiment.

FIG. 3 illustrates a pixel circuit according to one exemplary embodiment. FIG. 4 illustrates a cross-sectional view of a display panel including a driving transistor with four independent terminals according to one exemplary embodiment.

Referring to FIGS. 1 and 3, the pixel circuit PC may include an organic light emitting diode OLED, a driving transistor TD, a capacitor CST, and a switching transistor TS.

The driving transistor TD may include four independent terminals. The four independent terminals may operate independently of each other. The driving transistor TD may include a first gate electrode GE11 connected to the switching transistor TS, a drain electrode DE1 to receive the first emission power supply voltage ELVDD, a source electrode SE1 connected to the anode electrode of the organic light emitting diode OLED and a second gate electrode GE12 to receive the independent bias voltage Vb. The first emission power supply voltage ELVDD may be a power supply voltage having a high level.

The capacitor CST may include a first electrode CE1 to receive the first emission power supply voltage ELVDD and a second electrode CE2 connected to the first gate electrode GE11 of the driving transistor TD.

The switching transistor TS may include a gate electrode GE2 connected to the scan line SL and receiving the scan signal S, a drain electrode DE2 connected to a data line DL and to receive a data voltage Vdata, and a source electrode SE2 connected to the first gate electrode GE11 of the driving transistor TD. The switching transistor TS may have three independent terminals (e.g., the gate electrode GE2, the source electrode SE2, and the drain electrode DE2). In other words, the switching transistor TS and the driving transistor TD may be different-type transistors.

The organic light emitting diode OLED may include an anode electrode connected to the source electrode SE1 of the driving transistor TD and a cathode electrode to receive a second emission power supply voltage ELVSS. The second emission power supply voltage ELVSS may be a power supply voltage having a low level.

According to one exemplary embodiment, a driving method of the pixel circuit PC is as follows. The second gate electrode GE12 of the driving transistor TD may receive an independent bias voltage Vb through the second voltage line VL2. A driving voltage range VD_range of the driving transistor TD may be controlled according to a level of the independent bias voltage Vb. Further, a threshold voltage Vth of the driving transistor may be controlled by the independent bias voltage Vb.

For example, during a period in which the pixel circuit PC operates, the independent bias voltage Vb may be always applied to the second gate electrode GE 12 of the driving transistor TD. Alternatively, the independent bias voltage Vb may be selectively applied to the second gate electrode GE 12 of the driving transistor TD when the pixel circuit PC operates. The driving voltage range VD_range of the driving transistor TD may be a voltage range of the first gate electrode GE11 (e.g., a gate voltage range of the driving transistor TD) when data voltages corresponding to a middle grayscale or higher grayscales are applied to the first gate electrode GE11 of the driving transistor TD. In other words, the driving transistor TD may generate driving currents corresponding to the middle grayscale and the higher grayscales when the gate voltage of the driving transistor TD is in the driving voltage range VD_range of the driving transistor TD. For example, the driving transistor TD may have a channel including an oxide semiconductor, and a length of the channel may be about 3 μm or less. A voltage level of the independent bias voltage Vb may be about −7 V to about 6 V.

For example, when a scan signal S is supplied through the scan line SL, the switching transistor TS may be turned on. The data voltage Vdata received through the data line DL may be applied to the capacitor CST through the switching transistor TS being turned on. The data voltage Vdata applied to the capacitor CST may be applied to the first gate electrode GE11 of the driving transistor TD. The driving transistor TD may be driven by a driving current ID corresponding to the data voltage Vdata stored in the capacitor CST. The driving current ID may be applied to the organic light emitting diode OLED. The organic light emitting diode OLED may emit a light by the driving current ID. The light generated by the driving current ID may have a luminance corresponding to the data voltage Vdata.

For example, when the pixel circuit PC is driven, the independent bias voltage Vb may be always applied to the second gate electrode GE12 of the driving transistor TD. Alternatively, when the pixel circuit PC is driven, the independent bias voltage Vb may be selectively applied to the second gate electrode GE12 of the driving transistor. For example, the first and second gate electrodes GE11 and GE12 of the driving transistor TD may receive different voltages and may operate independently of each other. The driving transistor TD may have a channel including an oxide semiconductor and a channel length of about 3 μm or less.

Referring to FIG. 4, the display panel 100 may include a base substrate 110, a driving transistor TD, a second voltage line VL2, a storage capacitor CST, and an organic light emitting diode OLED according to one exemplary embodiment.

The base substrate 110 may be an insulating substrate including glass, polymer, stainless steel, or the like. The base substrate 110 may include a first plastic layer, a first barrier layer, a second plastic layer, and a second barrier layer that are sequentially stacked. For example, the first and second plastic layers may be formed of a material selected from the group consisting of polyimide (PI), polyethylene naphthalate (PEN), polyethylene terephthalate (PET), polyarylate (PAR), Polycarbonate (PC), polyetherimide (PEI), polyethersulfone (PS), and the like. The first and second barrier layers may comprise silicon compounds such as amorphous silicon (a-Si), silicon oxide (SiOx), silicon nitride (SiNx), and the like.

The driving transistor TD may be disposed on the base substrate 110. The driving transistor TD may include an active pattern A, a first gate electrode GE11, a source electrode SE1, a drain electrode DE1 and a second gate electrode GE12. For example, a first insulating layer 120 may be between the active pattern A and the second gate electrode GE12 and may overlap the active pattern A, the source electrode SE, and the drain electrode DE1. A gate insulating layer 130 may be between the active pattern A and the first gate electrode GE11.

The active pattern A may be formed of polysilicon or an oxide semiconductor. The oxide semiconductor may be at least one selected from the group consisting of titanium (Ti), hafnium (Hf), zirconium (Zr), aluminum (Al), tantalum (Ta), germanium (Ge), zinc (Zn) Or an oxide based on indium (In) and/or a composite oxide thereof. The composite oxide may be at least one selected from the group consisting of zinc oxide (ZnO), indium-gallium-zinc oxide (In—Ga—Zn—O), indium-zinc oxide (Zn—In—O), zinc-Zr—O), indium-gallium oxide (In—Ga—O), indium-tin oxide (In—Sn—O), indium-zirconium oxide (In—(In—Zr—Ga—O), indium-zirconium-tin oxide (In—Zr—Sn—O), indium-zirconium-gallium oxide Aluminum oxide (In—Zn—Al—O), indium-tin-aluminum oxide (In—Sn—Al—O), indium-aluminum-gallium oxide (In-Tantalum-tin oxide (In—Ta—Zn—O), indium-tantalum-gallium oxide (In—Ta—Ga—O) Germanium-gallium oxide (In—Ge—O), indium-germanium-zinc oxide (In—Ge—Zn—O), indium-germanium-tin oxide-Ge—Ga—O), titanium-indium-zinc oxide (Ti—In—Zn—O), hafnium-indium-zinc oxide (Hf—In—Zn—O).

The active pattern A may include a source region AS, a channel region AC, and a drain region AD, and the channel region AC. The active pattern A may be doped with an N-type impurity or a P-type impurity. The source region AS and the drain region AD may be spaced apart via the channel region AC and may be doped with an impurity of the opposite type to the doped impurity in the channel region AC.

The channel of the driving transistor TD may be defined by the channel region AC. The channel length of the driving transistor TD may be designed to be about 3 μm or less as the display panel has the high resolution.

The source electrode SE1 may be connected to the source region AS through a first contact hole formed in a second insulating layer 140. The drain electrode DE1 may be connected to the drain region AD through a second contact hole formed in the second insulating layer 140. The second gate electrode GE12 may overlap the active pattern A and may be disposed below the active pattern A.

The second voltage line VL2 may be connected to the second gate electrode GE2, which is a fourth terminal of the driving transistor TD, through a third contact hole formed in the first and second insulating layers 120 and 140. The second voltage line VL2 may be applied an independent bias voltage Vb. The independent bias voltage Vb may be applied to the second gate electrode GE2. According to the voltage level of the independent bias voltage Vb, the threshold voltage Vth of the driving transistor TD, the sub-threshold voltage slope SS, and the mobility Mob may be controlled or adjusted.

According to one exemplary embodiment, the driving voltage range VD_range of the driving transistor TD may be about 3 V, and the threshold voltage Vth may be about −5 V to about 5 V, so that the independent bias voltage Vb may be about −7 V to about 6V.

The capacitor CST may include a first electrode CE1, a second electrode CE2 overlapping the first electrode CE1, and the second insulating layer 140 interposed between the first and second electrodes CE1 and CE2. For example, the first electrode CE1 of the capacitor CST may be formed of the same metal layer as the first gate electrode GE11 of the driving transistor TD. The second electrode CE2 of the capacitor CST may be formed of a same metal layer as the source and drain electrodes CE1 and DE1 of the driving transistor TD.

The organic light emitting diode OLED may include an anode electrode E1, an organic light emitting layer OL, and a cathode electrode E2. For example, the anode electrode E1 may be connected to the drain electrode DE1 of the driving transistor TD through a fourth contact hole. At least one of the anode electrode E1 and the cathode electrode E2 of the organic light emitting diode OLED may be any one of a light transmitting electrode, a light reflecting electrode, and a light semipermeable electrode. The light emitted from the organic light emitting layer OLED may be transmitted through the anode electrode E1 or toward the cathode electrode E2.

Figure 5:
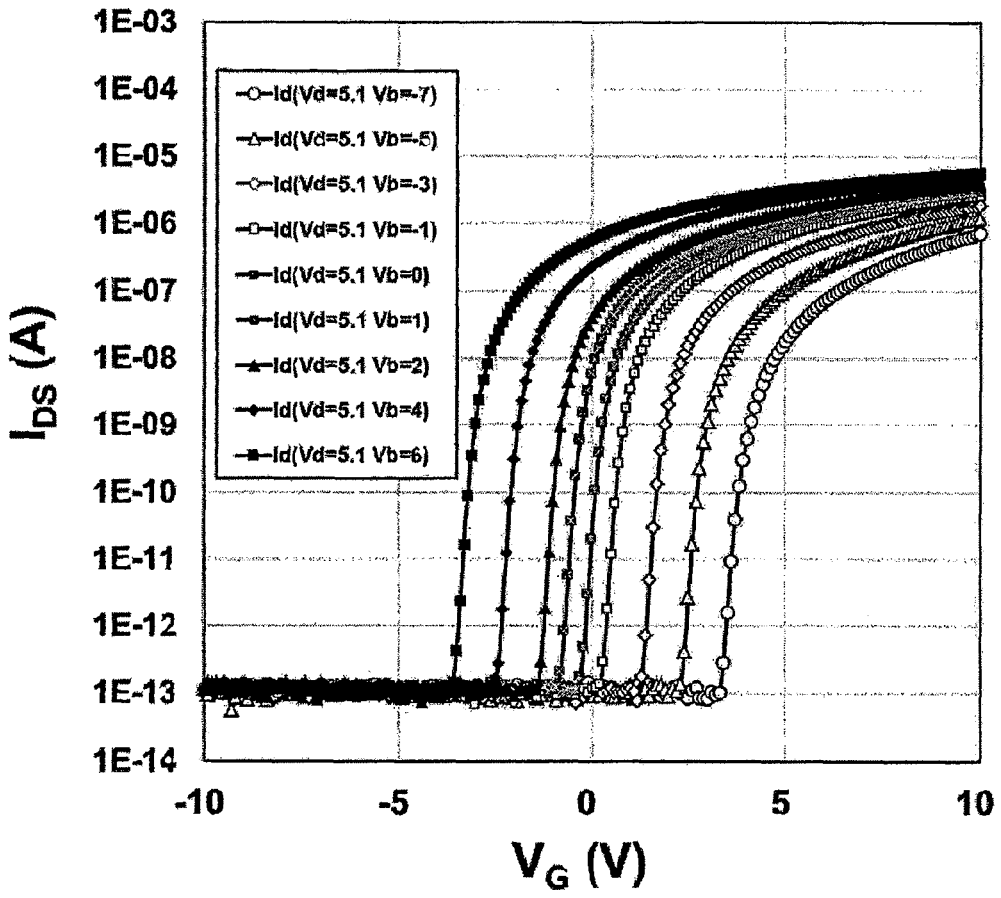
FIG. 5 illustrates a current-voltage (I-V) characteristic curve of a four-terminal transistor according to one exemplary embodiment.

FIG. 5 illustrates a current-voltage (I-V) characteristic curve of a four-terminal transistor according to one exemplary embodiment. FIG. 6 illustrates experimental data of an independent bias voltage and a driving voltage range of a four-terminal transistor according to one exemplary embodiment.

Referring to FIGS. 3, 5 and 6, according to one exemplary embodiment, the driving transistor TD having the four independent terminals may include a channel including an oxide semiconductor, e.g., indium-germanium-zinc oxide (In—Ge—Zn—O), a first gate electrode GE11 on the channel, a source electrode SE1, a drain electrode DE1, and a second gate electrode GE12 below the channel. The driving transistor TD may have a channel length of about 2.5 μm.

The drain electrode DE1 of the driving transistor TD may receive a drain voltage Vd of about 5.1 V according to the first emission power supply voltage ELVDD. An independent bias voltage Vb may be applied to the second gate electrode GE12 of the driving transistor TD.

For example, referring to FIG. 6, in a first condition, when the independent bias voltage Vb of about −7 V is applied to the second gate electrode GE 12 of the driving transistor TD, the turn-on current Ion of the driving transistor TD may be about 2.20E-06 A (i.e., about 2.2 μA), the threshold voltage Vth may be about 4.71 V, the driving voltage range VD_range may be about 4.69 V, and the sub-threshold voltage slope SS may be about 0.20 V/dec, and the mobility Mob may be about 1.73 $cm^2/V\cdot s$.

In a second condition, when an independent bias voltage Vb of about −5 V may be applied to the second gate electrode GE12 of the driving transistor TD, the turn-on current Ion of the driving transistor TD may be about 2.98E-06 A (i.e., about 2.98 μA), the threshold voltage Vth may be about 3.51 V, the driving voltage range VD_range may be about 4.21 V, the sub-threshold voltage slope SS may be about 0.16 V/dec, and the mobility Mob may be about 2.04 $cm^2/V\cdot s$.

In a third condition, when an independent bias voltage Vb of about 1 V is applied to the second gate electrode GE12 of the driving transistor TD, the turn-on current Ion of the driving transistor TD may be about 5.65E-06 A (i.e., about 5.65 μA), the threshold voltage Vth may be about 0.11 V, the driving voltage range VD_range may be about 3.08 V, the sub-threshold voltage slope SS may be about 0.15 V/dec, and the mobility Mob may be about 3.85 $cm^2/V\cdot s$.

In a fourth condition, when an independent bias voltage Vb of about 6 V is applied to the second gate electrode GE12 of the driving transistor TD, the turn-on current Ion of the driving transistor TD may be about 7.91E-06 A, the threshold voltage Vth may be about −2.67 V, the driving voltage range VD_range may be about 2.63 V and the sub-threshold voltage slope SS may be about 0.14 V/dec, and the mobility Mob may be about 5.23 $cm^2/V\cdot s$.

As illustrated in FIG. 6, the driving voltage range VD_range of the driving transistor TD may be increased as the voltage level of the independent bias voltage Vb decreases. For example, when the independent bias voltage Vb is about −15 V, the driving voltage range VD_range may be fully extended to about 7.37 V. In contrast, when the voltage level of the independent bias voltage Vb is low, the threshold voltage Vth of the driving transistor TD has a high voltage level.

As shown in FIG. 5, as the independent bias voltage Vb of the driving transistor TD decrease toward the negative polarity (−), the threshold voltage Vth of the driving transistor TD may be increased toward the positive polarity (+). As the independent bias voltage Vb increases toward the positive polarity (+), the threshold voltage Vth may be decreased toward the negative polarity (−). As the independent bias voltage Vb decreases, the driving voltage range VD_range may be increased.

When the driving transistor TD is driven for a long time, the threshold voltage Vth of the driving transistor TD may be shifted. The shifted threshold voltage Vth may be compensated through various compensation algorithms. The threshold voltage compensation may be difficult when the threshold voltage Vth of the driving transistor TD is preset to a voltage level too high or preset to a voltage level too low. Thus, the voltage level of the threshold voltage Vth may be preset to about +5 V to about −5 V in consideration of the threshold voltage compensation.

As described above, the voltage level of the independent bias voltage Vb may be preset in consideration of the voltage level of the threshold voltage Vth within a range in which the driving voltage range VD_range may be obtained to about 3V.

According to one exemplary embodiment, the voltage level of the independent bias voltage Vb may be preset to about −7 V to about 6 V in consideration of the threshold voltage Vth and the driving voltage range DR. When the voltage level of the independent bias voltage Vb is about −7 V to about 6 V, the driving voltage range VD_range may have about 4.69 V to about 2.63 V, and the voltage level of the threshold voltage Vth may have about 4.71 V to about 2.67 V.

According to one exemplary embodiment, the driving voltage range of the driving transistor may be about 2 V or more to about 5 V or less. The threshold voltage of the driving transistor may be about −5 V to about 5 V. The sub-threshold voltage slope of the driving transistor may be about 0.11 V/dec to about 0.21 V/dec.

According to exemplary embodiments of the present invention, the driving transistor with a channel length of less than 3 μm may include four independent terminals and may achieve the driving voltage range VD_range of about 3 V by applying an independent bias voltage Vb of about −7 V to about 6 V to a fourth terminal (e.g., a second gate terminal) of the driving transistor. Thus, when the channel length of the driving transistor is short in the organic light emitting display device having a high resolution, an appropriate driving voltage range may be obtained by the independent bias voltage Vb to improve the display quality. Therefore, although the channel length of the driving transistor is short in an organic light emitting display device having a high resolution, a sufficient driving voltage range may be obtained to improve the display quality.

Exemplary embodiments may be applied to a display device and an electronic device having the display device. For example, exemplary embodiments may be applied to a computer monitor, a laptop, a digital camera, a cellular phone, a smart phone, a smart pad, a television, a personal digital assistant (PDA), a portable multimedia player (PMP), a MP3 player, a navigation system, a game console, a video phone, etc.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. An organic light emitting display device comprising:

a display panel including a plurality of pixel circuits, each pixel circuit including a driving transistor having a channel region with a channel length of about 3 μm or less and four independent terminals, the four independent terminals including first and second gate electrodes, and an organic light emitting diode to emit a light according to a driving current generated from the driving transistor;

a source driving circuit to provide a data voltage to the plurality of pixel circuits such that a gate voltage corresponding to the data voltage is applied to the first gate electrode of the driving transistor; and a voltage generator to apply an independent bias voltage to the second gate electrode of the driving transistor, the independent bias voltage for controlling a driving voltage range of the driving transistor, wherein a voltage level of the independent bias voltage has a range from about −7 V to about 6 V.

2. The organic light emitting display device as claimed in claim 1, wherein the driving transistor further includes a drain electrode to receive a first emission power supply voltage and a source electrode connected to the organic light emitting diode.

3. The organic light emitting display device as claimed in claim 1, wherein the driving voltage range of the driving transistor is a range of gate voltages corresponding to data voltages corresponding to a middle grayscale and higher grayscales.

4. The organic light emitting display device as claimed in claim 1, wherein the driving voltage range of the driving transistor is from about 2 V to about 5 V.

5. The organic light emitting display device as claimed in claim 1, wherein the driving voltage range of the driving transistor is from about −5 V to about 5 V.

6. The organic light emitting display device as claimed in claim 1, wherein a sub-threshold voltage slope of the driving transistor has a range from about 0.11 V/dec to about 0.21 V/dec.

7. The organic light emitting display device as claimed in claim 1, wherein:

each pixel circuit further includes a switching transistor and a capacitor, the switching transistor includes a gate electrode connected to a scan line, a source electrode connected to a data line, and a drain electrode connected to the first gate electrode of the driving transistor, and the capacitor includes a first electrode connected to the first gate electrode of the driving transistor and a second electrode to receive a first emission power supply voltage.

8. The organic light emitting display device as claimed in claim 1, wherein:

the display panel includes a base substrate, an active pattern of the driving transistor containing the channel region, and a voltage line to transfer the independent bias voltage, the first gate electrode overlaps the channel region of the active pattern and is on the active pattern, the second gate electrode is on the base substrate, is under the channel region, and is connected to the voltage line, and the active pattern includes an oxide semiconductor, overlaps the second gate electrode, and is on the second gate electrode, and wherein the active pattern is between the first and second gate electrodes.

9. A method of driving an organic light emitting display device including a plurality of pixel circuits, each pixel circuit including an organic light emitting diode and a driving transistor having a channel region with a channel length of about 3 μm or less and four independent terminals, the four independent terminals including first and second gate electrodes, the method comprising:

applying a gate voltage corresponding to a data voltage to the first gate electrode of the driving transistor;

applying an independent bias voltage to the second gate electrode of the driving transistor to control a driving voltage range of the driving transistor; and applying a driving current based on the gate voltage to the organic light emitting diode, wherein a voltage level of the independent bias voltage has a range from about −7 V to about 6 V.

10. The method as claimed in claim 9, wherein the driving transistor further includes a drain electrode to receive a first emission power supply voltage and a source electrode connected to the organic light emitting diode.

11. The method as claimed in claim 9, wherein the driving voltage range of the driving transistor has a range from about 2 V to about 5 V.

12. The method as claimed in claim 9, wherein the driving voltage range of the driving transistor has a range from about −5 V to about 5 V.

13. The method as claimed in claim 9, wherein a sub-threshold voltage slope of the driving transistor has a range from about 0.11 V/dec to about 0.21 V/dec.

14. The method as claimed in claim 9, further comprising:

applying the gate voltage corresponding to the data voltage to the first gate electrode of the driving transistor in response to a scan signal;

storing the gate voltage of the first gate electrode in a capacitor; and applying a driving current to the organic light emitting diode based on a voltage stored in the capacitor by the driving transistor.

15. The method as claimed in claim 9, wherein the independent bias voltage is applied through a voltage line connected to the second gate electrode of the driving transistor.

16. A pixel unit comprising:

an organic light emitting diode to emit a light corresponding to a data voltage of a grayscale; and a pixel circuit to drive the organic light emitting diode according to the data voltage of the grayscale, the pixel circuit including a driving transistor having four independent terminals, the four independent terminals including first and second gate electrodes, wherein:

the driving transistor generates a driving current according to a first gate voltage of the first gate electrode of the driving transistor corresponding to the data voltage of the grayscale and supplies the driving current to the organic light emitting diode, and a driving voltage range of the driving transistor and a sub-threshold voltage slope of the driving transistor are controlled by a second gate voltage of the second gate electrode of the driving transistor, the second gate voltage of the second gate electrode of the driving transistor being charged with an independent bias voltage set to cause the driving voltage range of the driving transistor to be from about −5 V to about 5 V and to cause a sub-threshold voltage slope of the driving transistor has a range from about 0.11 V/dec to about 0.21 V/dec.

17. The pixel unit as claimed in claim 16, wherein the driving voltage range of the driving transistor is a range of first gate voltages of the driving transistor corresponding to data voltages of a middle grayscale and higher grayscales.

18. The pixel unit as claimed in claim 16, wherein the driving voltage range of the driving transistor has a range from about 2 V to about 5 V.

19. An organic light emitting display device comprising:

a display panel including a plurality of pixel circuits, each pixel circuit including a driving transistor having four independent terminals, the four independent terminals including first and second gate electrodes, and an organic light emitting diode to emit a light according to a driving current generated from the driving transistor;

a source driving circuit to provide a data voltage to the plurality of pixel circuits such that a gate voltage corresponding to the data voltage is applied to the first gate electrode of the driving transistor; and a voltage generator to apply an independent bias voltage to the second gate electrode of the driving transistor, the independent bias voltage for controlling a driving voltage range of the driving transistor, wherein the independent bias voltage is provided to the second gate electrode of the driving transistor from the voltage generator without passing through any transistor in the each pixel circuit.

* * * * *